US006612765B2

(12) United States Patent
Lee et al.

(10) Patent No.: US 6,612,765 B2
(45) Date of Patent: Sep. 2, 2003

(54) CORE GUIDE ASSEMBLY FOR STATIONERY ARTICLE

(75) Inventors: Sun-Hyung Lee, Daejeon (KR); Byoung-Whoo Min, Daejeon (KR)

(73) Assignee: Dong-A Teaching Materials Co., Ltd., Daejong (KR)

( * ) Notice: Subject to any disclaimer, the term of this patent is extended or adjusted under 35 U.S.C. 154(b) by 0 days.

(21) Appl. No.: 10/007,079

(22) Filed: Nov. 13, 2001

(65) Prior Publication Data

US 2003/0026641 A1 Feb. 6, 2003

(30) Foreign Application Priority Data

Jul. 31, 2001 (KR) ..... 2001-0023184

(51) Int. Cl.[7] ..... A45D 40/20
(52) U.S. Cl. ..... 401/88; 401/75
(58) Field of Search ..... 401/88, 68, 75

(56) References Cited

U.S. PATENT DOCUMENTS 2,815,123 A * 12/1957 Safianoff ..... 401/68
4,605,330 A * 8/1986 Crowley et al. ..... 401/68
6,254,325 B1 * 7/2001 Kun ..... 411/38

* cited by examiner

*Primary Examiner*—David J. Walczak
(74) *Attorney, Agent, or Firm*—Harness, Dickey & Pierce, P.L.C.

(57) ABSTRACT

A core guide assembly for a stationery article includes a screw member with a predetermined length while externally bearing a male screw. A support member is connected to the one-sided end of the screw member while centrally bearing a support bar protruded opposite to the screw member. The support bar has a support protrusion with one or more portions bearing a large volume in the radial direction. The support protrusion is formed at the end portion of the support bar by one or two steps while bearing a shape of a cone or a disk, or arranged at the support bar by two or more steps in a zigzag while bearing a shape of a semi-cone or a semi-disk.

2 Claims, 8 Drawing Sheets

CORE GUIDE ASSEMBLY FOR STATIONERY ARTICLE

BACKGROUND OF THE INVENTION (a) Field of the Invention

The present invention relates to a core guide assembly for a stationery article and, more particularly, to a core guide assembly for a stationery article which prevents separation of a core by way of a support protrusion.

(b) Description of the Related Art

A stationary article such as a glue, an eraser, a crayon and a pencil may be provided with a core guide assembly for guiding a bar-shaped core such that the core can be gradually exposed to the outside for use.

As shown in FIGS. 1 and 2, the stationery article includes a tube case 2 both ends of which are in an opening state, a bar-shaped core 1 mounted within the tube case 2, a rotation unit 4 fitted to the one-sided end of the tube case 2 such that it can be rotated, and a core guide assembly 10 inserted into the tube case 2 such that it can move along the inner surface of the tube case 2 in the longitudinal direction. For instance, the bar-shaped core may be a glue stick.

The movement of the core guide assembly 10 is made by way of clockwise and anticlockwise rotations of the rotation unit 4, and the one-sided end of the core guide assembly 10 partially supports the core 1.

A cap 8 is externally fitted to the other-sided end of the tube case 2 such that it can intercept the core 1 from the outside. The cap 8 has a clip 9 for holding the article to a coat collar, or a pocket collar.

The rotation unit 4 includes a rotation member 5 fitted to the one-sided end of the tube case 2 such that it can be rotated, and an operation member 6 inserted into the tube case 2 such that it can be rotated together with the rotation member 5. The operation member 6 mounts the core guide assembly 10 therein.

The core guide assembly 10 has a screw member 11 externally bearing a male screw, and a support member 12 moving together with the screw member 11 while partially supporting the core 1.

One or more operation protrusions 7 are internally formed at the operation member 6 of the rotation unit 4 such that they are inserted into the grooves of the screw member 11.

A guide groove 13 is longitudinally formed at the lateral side of the support member 12, and a guide protrusion 3 is formed at the inner surface of the tube case 2 such that it is inserted into the guide groove 13. The guide protrusion 3 guides the movement of the core guide assembly 10 in the longitudinal direction while prohibiting the rotation thereof.

When the rotation unit 4 is rotated with the formation of the operation protrusions 7 and the guide protrusion 3, the operation member 6 is rotated in its own place because it is fitted to the tube case 2 while being prohibited in its movement in the longitudinal direction. Since the core guide assembly 10 where the screw member 11 thereof is fitted to the operation protrusions 7 is prohibited in its rotation by way of the guide protrusion 3, the core guide assembly 10 performs its guiding operation while moving back and forth pursuant to the rotation of the rotation unit 4.

As the core guide assembly 10 performs its guiding operation, the core 1 held by the support member 12 of the core guide assembly 10 is exposed to the outside, or intercepted from the outside.

A plurality of support protrusions 14 are formed at the inner surface of the support member 12 of the core guide assembly 10 to support the core 1.

The core 1 occupying the charge space 15 of the support member 12 is partially held by the support protrusions 14, and moves together with the core guide assembly 10. The core 1 is partially influenced by the elastic force of the support member 12 that suffers expansion and contraction during the charge of the core 1.

In operation, when the core guide assembly 10 moves forward pursuant to the rotation of the rotation unit 4, the core 1 is pushed upward by way of the support member 12 so that the movement of the core 1 can be made in a smooth manner.

However, when the core guide assembly 10 moves backward, the core 1 also moves while being influenced by the elastic force of the support member 12 of the core guide assembly 10, and held by the support protrusions 14. In case the core 1 is formed with a soft material such as a solid paste, the core 1 is deformed due to the abrasion force occurring between the core 1 and the tube case 2 so that it slides over the support protrusions 14. In this case, the core 1 is separated from the support member 12 so that the backward movement thereof cannot be made.

Particularly, in case the diameter of the core 1 is 10 mm or less, the supporting power of the support protrusions 14 becomes reduced, and this facilitates the separation of the core 1 from the support member 12.

When the core 1 is separated from the support member 12 and the backward movement thereof is not made, the end portion of the core 1 is largely exposed to the outside of the tube case 2. In this state, when the cap 8 is closed, the core 1 is partially attached to the cap 8 while being deformed in its shape and contaminating the surroundings.

SUMMARY OF THE INVENTION

It is an object of the present invention to provide a core guide assembly for a stationery article which has a cylinder-shaped support bar externally bearing a support protrusion to support a core in a stable manner.

This and other objects may be achieved by a core guide assembly for a stationery article with the following features.

The core guide assembly includes a screw member with a predetermined length while externally bearing a male screw. A support member is connected to the one-sided end of the screw member while centrally bearing a support bar protruded opposite to the screw member. The support bar has a support protrusion with one or more portions bearing a large volume in the radial direction.

The support protrusion is formed at the end portion of the support bar by one or two steps while bearing a shape of a cone or a disk.

Alternatively, the support protrusion portions are arranged at the support bar by two or more steps in a zigzag while bearing a shape of a semi-cone or a semi-disk. Furthermore, the support protrusion portions may be shaped with polygonal plates such as a rectangular plate.

The support protrusion may be formed with two or more stepped portions bearing a shape of a cone, a disk, or a polygonal plate. Furthermore, the support protrusion may have two or more stepped portions with a shape of a semi-cone, a semi-disk or a polygonal plate arranged in a zigzag such that the portions thereof are protruded opposite to each other with respect to the axis of the support bar.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 3:
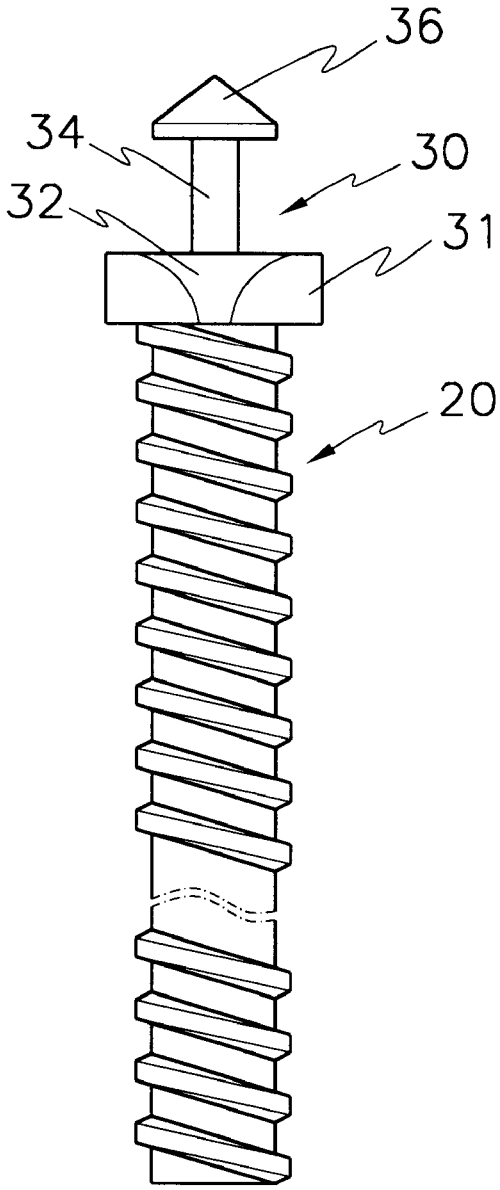
FIG. 3 is a side view of a core guide assembly for a stationery article according to a first preferred embodiment of the present invention.
Figure 4:
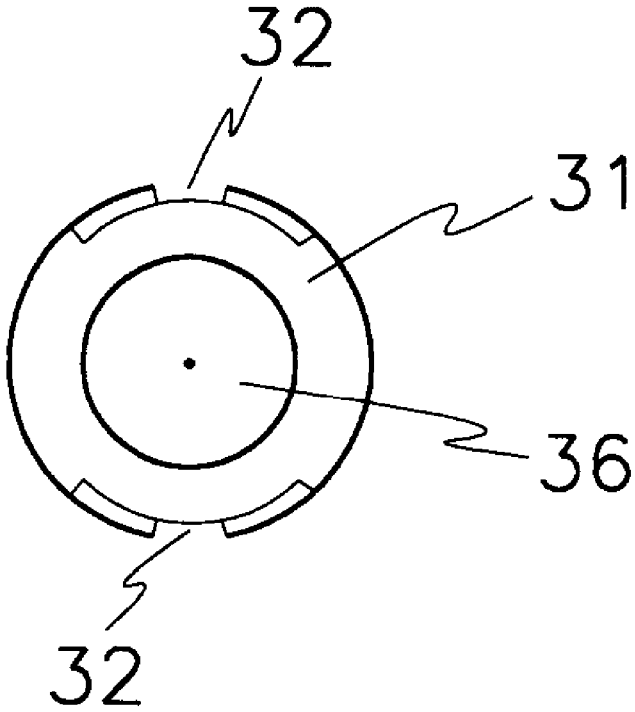
FIG. 4 is a plan view of the core guide assembly shown in FIG. 3.

FIG. 3 is a side view of a core guide assembly for a stationery article according to a first preferred embodiment of the present invention, and FIG. 4 is a plan view of the core guide assembly shown in FIG. 3.

As shown in FIGS. 3 and 4, the core guide assembly includes a screw member 20 with a predetermined length while externally bearing a male screw, and a support member 30 connected to the one-sided end of the screw member 20. The support member 30 has a support bar 34 protruded opposite to the screw member 20, and a cone-shaped support protrusion 36 protruded from the support bar 34 in the radial direction. The support protrusion 36 is established to bear a volume larger than the support bar 34.

The support member 30 further has a disk-shaped support plate 31 from which the screw member 20 and the support bar 34 proceed up and downward.

Figure 1:
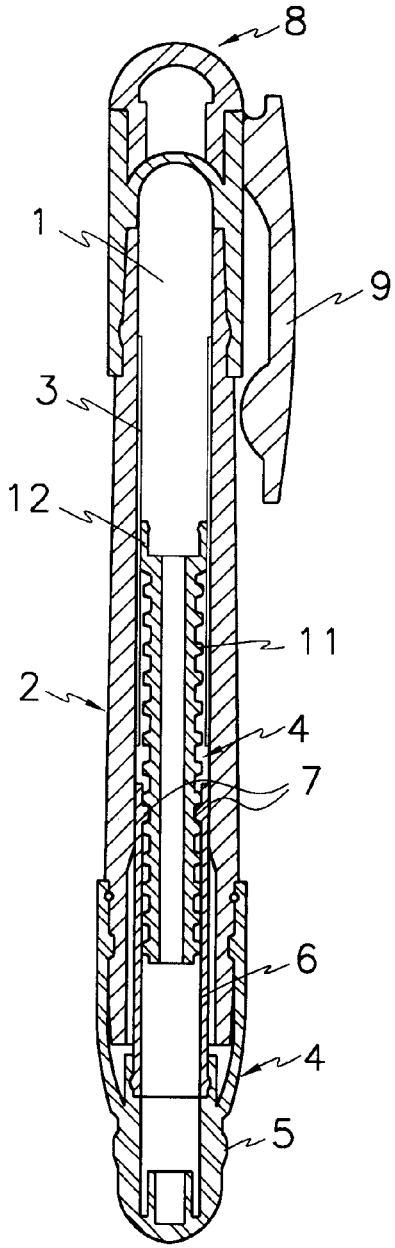
FIG.1(Prior Art)
FIG. 1 is a cross sectional view of a usual stationery article.
Figure 2:
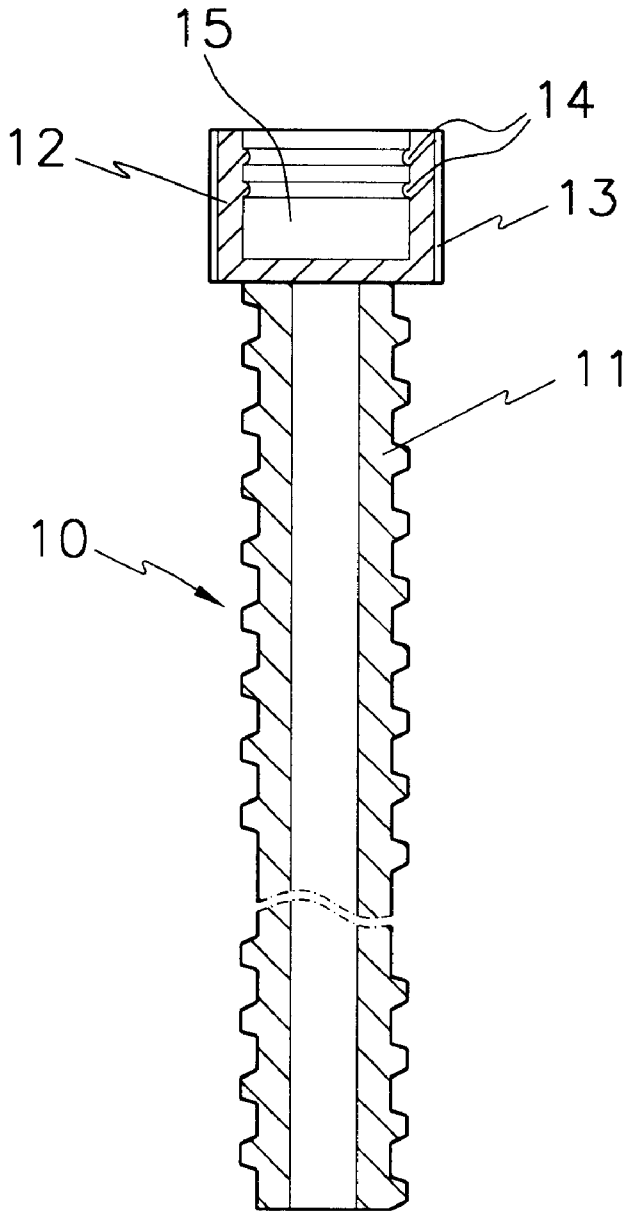
FIG.2 (Prior Art)
FIG. 2 is a cross sectional view of a core guide assembly for the stationery article shown in FIG. 1.

A guide groove 32 is formed at the circumference of the support plate 31. The guide protrusion 3 previously described with reference to FIG. 1 is inserted into the guide groove 32.

As with the guide groove 13 previously described with reference to FIG. 1, the guide groove 32 prohibit the rotation of the core guide assembly, and make the core guide assembly 10 move back and forth. The movement of the core guide assembly 10 is made by way of the screwing operation between the screw member 20 and the operation protrusions 7 formed at the operation member 6 of the rotation unit 4.

The support protrusion 36 is cone-shaped to smoothly guide the flow of the core 1 during the injection thereof, and make the core 1 uniformly fill the gap between the support protrusion 36 and the support plate 31 in a sufficient manner.

In order for the support protrusion 36 to bear a stable supporting power, it is preferably provided with a cylinder-shaped portion to be placed under the cone-shaped portion.

Alternatively, the support protrusion 36 may be shaped with a pyramid, a disk or a polygonal plate, or provided externally with one or more grooves to make the flow of the core 1 in a smooth manner.

Figure 5:
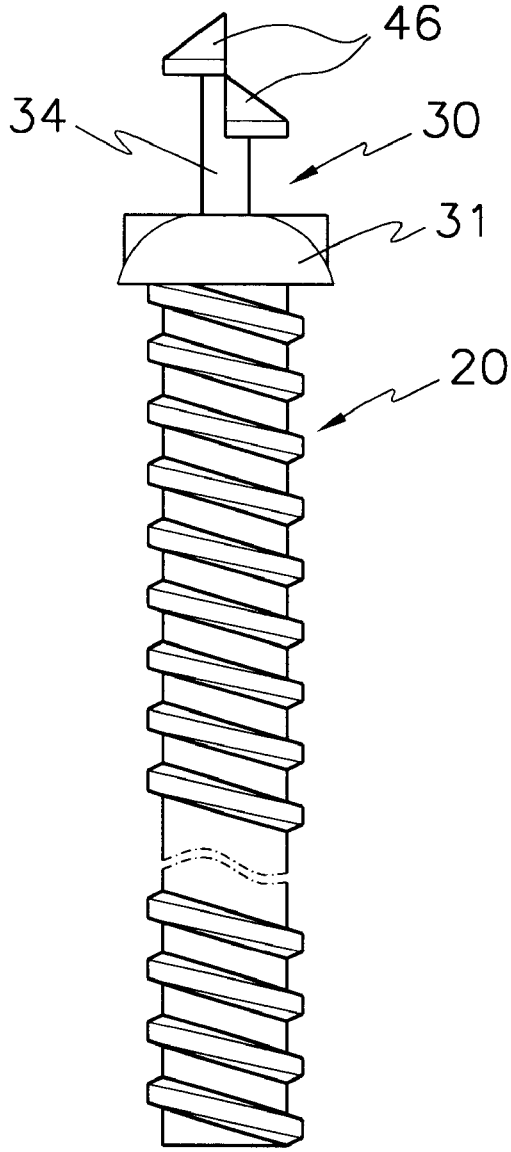
FIG. 5 is a side view of a core guide assembly for a stationery article according to a second preferred embodiment of the present invention.
Figure 6:
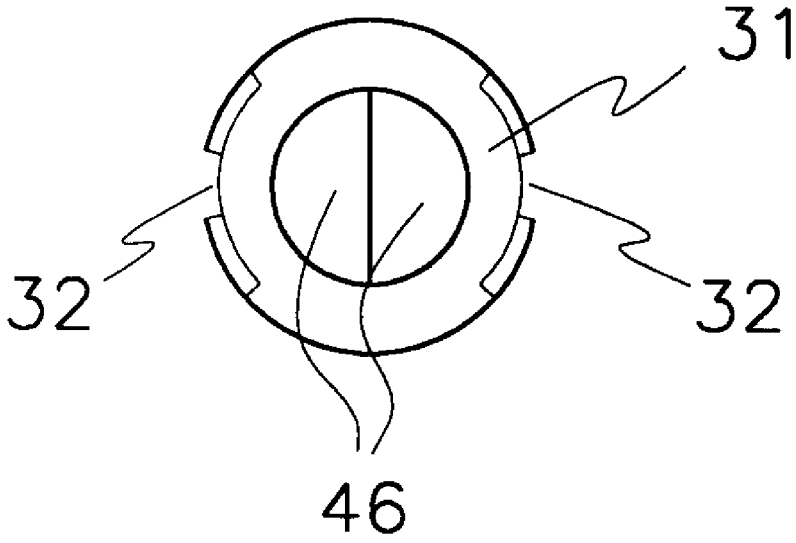
FIG. 6 is a plan view of the core guide assembly shown in FIG. 5.

FIG. 5 is a side view of a core guide assembly for a stationery article according to a second preferred embodiment of the present invention, and FIG. 6 is a plan view of the core guide assembly shown in FIG. 5. In this preferred embodiment, other components and structures of the core guide assembly are the same as those related to the first preferred embodiment except for the support protrusion.

As shown in the drawings, the support protrusion 46 has two stepped portions each with a shape of a semi-cone. The portions of the support protrusion 46 are arranged in a zigzag such that they are directed opposite to each other.

Alternatively, the support protrusion 46 may be formed with three or more stepped portions.

Figure 7:
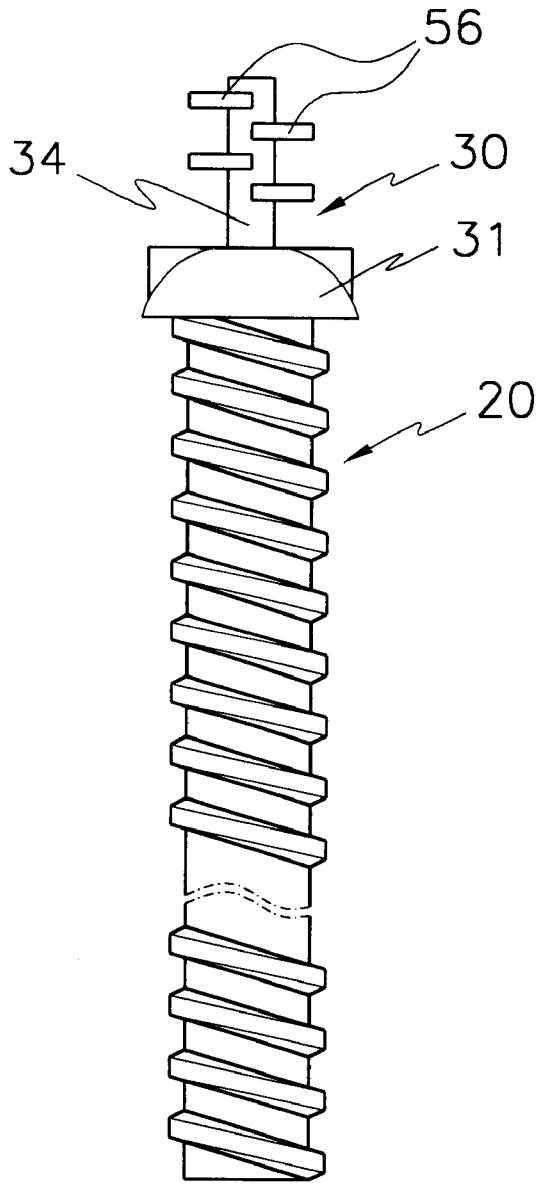
FIG. 7 is a side view of a core guide assembly for a stationery article according to a third preferred embodiment of the present invention.
Figure 8:
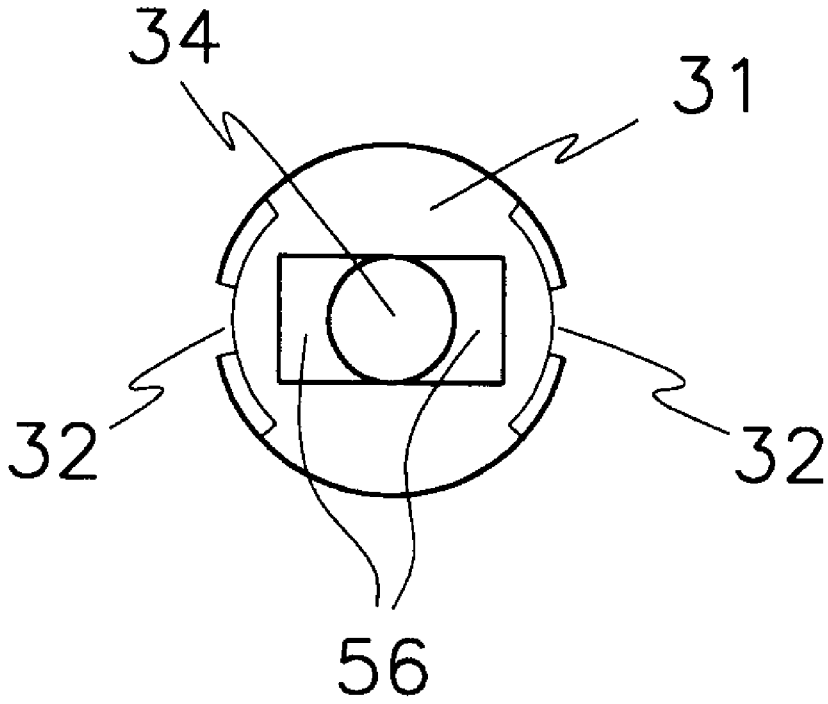
FIG. 8 is a plan view of the core guide assembly shown in FIG. 7.

FIG. 7 is a side view of a core guide assembly for a stationery article according to a third preferred embodiment of the present invention, and FIG. 8 is a plan view of the core guide assembly shown in FIG. 7. In this preferred embodiment, other components and structures of the core guide assembly are the same as those related to the first preferred embodiment except for the support protrusion.

As shown in the drawings, the support protrusion 56 has four stepped portions each with a shape of a plate. The portions of the support protrusion 56 are arranged in a zigzag such that they are protruded opposite to each other.

The portions of the support protrusion 56 may be shaped with a rectangular plate, a semi-disk, or a polygonal plate.

Alternatively, the support protrusion 46 may be formed with two, three, or five or more stepped portions.

Furthermore, the support protrusion 46 may be formed with a cone-shaped portion, a semi-cone shaped portion, and a rectangular plate-shaped portion in combination.

The above-described core guide assemblies may be formed using a partitioned molding technique.

The above-structured core guide assembly may be well applied for use in the stationery article shown in FIG. 1. When the rotation unit 4 is rotated in the normal direction to move the core 1 forward, the core 1 is pushed upward by way of the support plate 31. When the rotation unit 4 is rotated in the reverse direction to move the core 1 backward, the core 1 is pulled by the support protrusion 36, 46 or 56 while being supported thereby.

That is, the support protrusion 36, 46 or 56 bears a large volume in the radial direction with respect to the core 1, and the core 1 is partially existent under the support protrusion 36, 46 or 56. Accordingly, the core 1 moves by way of the pressure of the support protrusion 36, 46 or 56.

As described above, the bar-shaped core is supported by the large volume support protrusion during its movement so that the separation thereof from the support member can be prevented while making the core guiding operation in a smooth manner.

The bar-shaped core is safely positioned within the tube case for storage so that damage thereof or contamination of the cap does not occur.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A core guide assembly for a stationery article comprising:

a screw member with a predetermined length while externally bearing a male screw, the screw member having a front end and a rear end; and a support member connected to the rear end of the screw member, the support member comprising a disk-shaped support plate contacting the screw member while being circumferentially provided with a guide groove, a support bar protruded from the center of the support plate while proceeding opposite to the screw member, and a support protrusion protruded from the support bar with one or more protrusion portions bearing a large volume in the radial direction, wherein the support protrusion is formed with two or more stepped portions, and the portions of the support protrusion bear a shape of a cone, a disk, or a polygonal plate.

2. A core guide assembly for a stationery article comprising:

a screw member with a predetermined length while externally bearing a male screw, the screw member having a front end and a rear end; and a support member connected to the rear end of the screw member, the support member comprising a disk-shaped support plate contacting the screw member while being circumferentially provided with a guide groove, a support bar protruded from the center of the support plate while proceeding opposite to the screw member, and a support protrusion protruded from the support bar with one or more protrusion portions bearing a large volume in the radial direction, wherein the support protrusion has two or more stepped portions with a shape of a semi-cone, a semi-disk or a polygonal plate, and the portions of the support protrusion are arranged in a zigzag such that the portions thereof are protruded opposite to each other with respect to the axis of the support bar.

* * * * *